US006520122B2

(12) United States Patent
Kemp et al.

(10) Patent No.: US 6,520,122 B2
(45) Date of Patent: Feb. 18, 2003

(54) PRESSURIZED STEAM BOILERS AND THEIR CONTROL

(75) Inventors: Brendan Kemp, Kent (GB); Paul James Nichols, Kent (GB)

(73) Assignee: Autoflame Engineering Ltd., London (GB)

( * ) Notice: Subject to any disclaimer, the term of this patent is extended or adjusted under 35 U.S.C. 154(b) by 0 days.

(21) Appl. No.: 09/828,581

(22) Filed: Apr. 4, 2001

(65) Prior Publication Data

US 2002/0144662 A1 Oct. 10, 2002

(51) Int. Cl.[7] ..... F22B 37/46

(52) U.S. Cl. ..... 122/504.2; 122/448.1; 122/504

(58) Field of Search ..... 122/504–506, 122/448.1–448.2, 504.2, 507, 508, 459, 460, 486

(56) References Cited

U.S. PATENT DOCUMENTS

| | | | | |
|---|---|---|---|---|
| 3,042,007 A | | 7/1962 | Chien et al. | |
| 3,776,200 A | * | 12/1973 | Tine et al. | 122/504 |
| 3,834,357 A | * | 9/1974 | Kaczmarek et al. | 122/504 |
| 4,457,266 A | | 7/1984 | La Spisa | |
| 4,495,899 A | * | 1/1985 | Carberry | 122/504 |
| 4,497,283 A | * | 2/1985 | LaSpisa et al. | 122/504 |
| 4,598,668 A | * | 7/1986 | Bader | 122/504 |
| 5,111,691 A | * | 5/1992 | John et al. | 122/504 |
| 5,148,775 A | | 9/1992 | Peet | |
| 5,739,504 A | * | 4/1998 | Lyons et al. | 122/448.1 |

FOREIGN PATENT DOCUMENTS

| | | |
|---|---|---|
| DE | 37 41 653 | 6/1989 |
| GB | 2138610 | 4/1983 |
| GB | 2335736 | 7/1997 |
| WO | 98/29693 | 7/1998 |

* cited by examiner

*Primary Examiner*—Gregory Wilson
(74) *Attorney, Agent, or Firm*—Merchant & Gould P.C.

(57) ABSTRACT

The flow rate of water into a pressurised steam boiler heated by a burner is controlled by monitoring the level of water in the boiler, monitoring the pressure of steam in the boiler and monitoring the firing rate of the boiler. The level of water in the boiler is measured by a pair of capacitance probes. By controlling the water flow with regard not only to variables relating to the boiler but also variables relating to the burner, it is possible to provide a better control of water flow. Also, by assessing variables relating both to the burner operation and the boiler operation, an assessment of the mass flow rate of steam from the boiler can be made without employing a steam flow meter.

24 Claims, 4 Drawing Sheets

PRESSURIZED STEAM BOILERS AND THEIR CONTROL

TECHNICAL FIELD

The invention relates to pressurised steam boilers and their control, to a method and apparatus for detecting the level of water in a steam boiler and to a method and apparatus for assessing the mass flow of steam from a steam boiler.

BACKGROUND

In a known arrangement of a pressurised steam boiler, water is fed into the boiler at a controlled rate and is heated in the boiler to convert the water to steam. The heat required to convert the water to steam is provided by a burner whose hot products of combustion are passed through ducts in the boiler and then exhausted. The steam boiler is controlled by a boiler control system, which receives information from sensors indicating inter alia the level of water in the boiler and the presence of steam in the boiler, and which controls the flow rate of water into the boiler as well as sending a control signal to a burner control system that controls the burner The burner control system controls inter alia the flow of fuel and gas to the burner head in dependence upon a demand signal received from the boiler.

Pressurised steam boilers are potentially very hazardous because of the very high pressure that is maintained in the boiler and it is therefore essential for such boilers to have control systems that are extremely safe. One factor that is taken into account to ensure the safety of a system is the importance of maintaining the water level in the boiler within predetermined limits. The internationally recognised safety regime concerning adequate water level in pressurised steam boilers requires sensing arrangements to detect a first low water level ("first low") below the normal operating range of the boiler and also to detect a second low water level that is even lower than the first low water level. When the first low water level is detected, the boiler control system sends a signal to the burner control system causing the burner to be switched off. Provided the water level then rises back above the first low water level the boiler control system sends a further signal to the burner control system allowing the burner to restart. If, however, the water level continues to fall and reaches the second low water level, the boiler control system sends a further signal to the burner control system preventing it from restarting without manual intervention. The requirement for manual intervention is inconvenient, but is regarded as a necessary safety requirement.

The false triggering of either the first low or second low is costly. The effect of a false triggering at the first low is to turn off the burner; at best that may simply lead to less efficiency because the burner is switched completely off rather than simply being turned down to a lower firing rate; in a worst case, however, as will be explained below, the false triggering bay lead to the burner being switched off at a time when the demand for heat in the boiler is especially high. False triggering at the second low is more damaging because it is likely to last longer given that the burner can be restarted only after manual intervention.

False triggering can occur without any fault in the equipment. In particular, it is not unusual for there to be a sudden demand for steam from a steam boiler; in that case there may be a significant drop in pressure within the boiler which can cause the water level in the boiler to rise (because of the small bubbles of compressed gas trapped within the water in the boiler). The reduction in pressure rightly leads to a signal passing from the boiler control system to the burner control system to increase the firing rate of the burner, while the increase in water level in the boiler causes the usual water flow into the boiler to be reduced or stopped. As the system then recovers and the pressure in the boiler rises, the water level in the boiler falls quickly and may well fall below the "first low" leading to the burner being turned off at a time when it should be operating, probably at full capacity. It is even possible that the fall in water level will reach the "second low" so that the burner remains off until an operator resets the system.

Safety considerations also have an impact on the techniques that are employed to measure the level of water in the boiler. Because of the importance of detecting the "first low" and the "second low", separate probes are used to detect each of the levels; whilst one capacitative probe may sometimes be provided to sense water levels within the normal operating range, respective conductive probes, which sense whether or not they are in the water, but give no further indication of water level, are provided to detect the "first low" and the "second low". Often other conductive probes are set at other levels so that those other levels can be detected in a similar way. Thus a large number of separate probes are provided. A capacitative probe is not regarded as sufficiently reliable for detecting the "first low" and the "second low" water levels. One particular concern is that the signals for such probes may be affected by stray electromagnetic radiation generated by devices in the vicinity of the probes.

Operators of pressurised steam boilers frequently purchase steam flow meters to measure the steam flows in the steam exit lines from each of the boilers. A frequent reason for installing such meters is for auditing purposes, to enable the amount of steam exported from the boiler to be compared to the amount of fuel used by the boiler. Such meters are, however, expensive.

SUMMARY

It is an object of the invention to provide an improved method and apparatus for controlling the operation of a steam boiler.

It is a further object of the invention to provide a method and apparatus for controlling the operation of a steam boiler in which the likelihood of a burner being shut down unnecessarily is reduced.

It is a further object of the invention to provide an improved method and apparatus for detecting the level of water in a pressurised steam boiler, and especially to provide a method and apparatus in which the number of probes that are required is reduced.

It is a still further object of the invention to provide a method and apparatus for assessing the mass flow of steam from a pressurised steam boiler without resorting to a steam flow meter.

According to the invention there is provided a method of controlling the operation of a steam boiler heated by a burner, the method including the following steps:

a) monitoring the level of water in the boiler, b) monitoring the pressure of steam in the boiler, c) monitoring the firing rate of the burner, and d) controlling the flow rate of water into the boiler having regard to the signals resulting from a) and b) and, at least for some signal conditions, also having regard to signals resulting from c).

By using the firing rate of the burner as one of the control inputs for determining the flow rate of water into the boiler and in that respect combining the burner control system and the boiler control system, it becomes possible to effect a more appropriate control of the water, reduce the number of times that the water level in the boiler falls below a first low water level at which the burner is switched off and thereby improve the efficiency of the boiler.

Whilst it is within the scope of the invention for the control of the flow rate of water into the boiler always to take account of signals resulting from monitoring the firing rate of the burner, it may be that the signals resulting from monitoring the firing rate of the burner are taken into account in a limited set of circumstances only. It is for example preferred that when i) the monitoring of the level of water in the boiler shows a rate of increase above a predetermined level, ii) the monitoring of the pressure of steam in the boiler shows a reduction in pressure at a rate above a predetermined level, and iii) the monitoring of the firing rate of the burner shows that the firing rate is increasing at a rate above a predetermined level, the controlling of the flow rate of water into the boiler is such that it does not necessarily reduce the rate of flow into the boiler.

Preferably, said controlling of the flow rate of water into the boiler is such that it does not reduce the rate of flow into the boiler, unless the level of water in the boiler is above an upper normal working limit. In a case where there is a sudden demand for steam so that the steam pressure drops quickly and the water level in the boiler increases rapidly, the flow rate of water into the boiler is controlled in dependence upon what is concurrently happening to the firing rate of the burner: if the firing rate of the burner is increasing at a rate above a predetermined level, then that is an indication that the drop in steam pressure is a result of increased demand and that the increase in boiler water level is misleading, and the rate of flow of water into the boiler is not reduced. Since water continues to flow into the boiler the likelihood of the water level dropping below the first or second low water levels is significantly reduced.

An example of a situation where the monitoring of the firing rate would still lead to a reduction in the rate of flow of water into the boiler is given below: when i) the monitoring of the level of water in the boiler shows an increase in level but at a rate of increase below a predetermined level.

ii) the monitoring of the pressure in the boiler shows an increase in pressure but at a rate of increase below a predetermined level, and iii) the monitoring of the firing rate of the burner shows that the firing rate is reducing the controlling of the flow rate of water into the boiler is such that it does reduce the rate of flow into the boiler.

Preferably, input and output signals relating to all the monitoring and controlling steps are passed into or transmitted from a common control unit that also controls the operation of the burner. The integration of the boiler control unit and burner control unit into a single control unit simplifies, improves and makes cheaper the control of the burner and boiler.

Where reference is made above to a rate of increase above a predetermined level, it is within the scope of the invention for the rate of increase to be at any level above zero. It is preferred, however, that the predetermined level corresponds to what is to be regarded as a normal rate of increase during ordinary operation of the burner and boiler. Appropriate predetermined levels may be determined by a commissioning engineer during commissioning of the system and a rate of increase may be obtained by measuring the increase in values over a time period of the order of 20 seconds.

Where reference is made to monitoring a variable, it should be understood that the variable itself may not be directly sensed but rather one or more other variables, from which the variable being monitored can be calculated, may be sensed. For example, the firing rate of the burner need not be directly sensed and the pressure of the water in the boiler may be sensed to indicate the pressure of the steam.

In an especially preferred method, the step of monitoring the level of water in the boiler includes the steps of providing a pair of capacitance probe assemblies mounted in the boiler with each of the probes extending through a range of water levels, the probes being arranged such that the capacitance of each probe varies according to the level of the water, and of measuring the capacitance of each probe, comparing the capacitances to one another to check that they match and using the measurement of the capacitance as an indication of the water level. By providing a capacitance probe assembly to measure the water level in the boiler it becomes possible to measure a wide range of levels and, if desired, all the intermediate levels without a large number of probes. Furthermore, by providing a pair of probes that measure the same levels, safety can be considerably improved. Of course, more than two probes can be employed, if desired.

The range of water levels through which the probes extend preferably includes a first low water level below the normal working range. Thus the probes are preferably used to detect the "first low" Furthermore, the range of water levels through which the probes extend preferably includes a second low water level below the first low water level. Thus the probes are preferably also used to detect the "second low". Conventional capacitative probes have not been regarded as satisfactory for detecting the "first low" and "second low" because of the importance, from a safety point of view, of that detection. We have found, however. that by using a pair of probes to make the same measurements it is possible to provide a very safe detecting arrangement.

It is still further preferred that the range of water levels through which the probes extend include all other water levels that are to be detected. In that case there is no need to provide any other water level detectors apart from the probes. The further water levels detected by the probes may be the limits of the normal working range of water level and/or a high water level above the normal working range.

Each of the capacitance probes preferably projects downwardly from an upper region of the boiler housing. Each probe preferably comprises an elongate core of electrically conducting material surrounded by a sleeve of electrically insulating material.

Preferably the pair of capacitance probe assemblies are substantially identical.

Each capacitance probe assembly preferably includes in addition a reference capacitance whose capacitance value is sensed alternately with the probe capacitance value. By providing such a reference capacitance value in each probe assembly, it is possible to detect any distortion of the sensed value of capacitance that might arise from, for example, electromagnetic radiation. Any such distortion in the sensed value of the reference capacitance may be used to adjust the sensed capacitance value of the capacitance of the probe and/or may be used to switch off the burner as a safety precaution.

Preferably the measurement of the capacitance of one probe alternates with the measurement of the capacitance of the other probe.

An especially preferred method of the invention further includes the step of assessing in a control unit the mass flow of steam from the boiler by processing of input signals including ones enabling assessments to be made of:

a) the heat generated by combustion in the burner b) the temperature and pressure of the steam generated by the boiler c) the heat dissipated other than in the steam.

It should be understood that a designer is able to make some selections as to how accurate the assessments of a) to c) above are to be and therefore how many variables are to be measured and how accurately they are to be measured. For example, in order to assess the heat dissipated other than in steam an operator might merely measure the temperature of the combustion products and assume a certain further dissipation of heat by other means such as conduction, convection and radiation from the boiler housing By making an assessment of the mass flow of steam from measurements of other variables, the need for an expensive steam flow meter is avoided. Although it may appear that the measurement of several other variables in order to assess the steam flow is unnecessarily expensive and complicated, that need not be so because the other variables may be mainly or entirely ones that are being measured anyway for the purpose of controlling the operation of the pressurised steam boiler and burner.

Variables measured to assess the heat generated by combustion in the burner may include the rate of feeding of s fuel to the burner, and/or the composition of the combustion products.

Variables measured to assess the heat dissipated other than in the steam may include the temperature of the combustion products and/or the rate of feeding fuel to the burner.

In GB 2169726A, the description of which is incorporated herein by reference, a fuel burner control system is described which includes flue gas sampling and analysing apparatus and which also includes a burner controller which is the subject of GS 2138610A, the description of which is also incorporated herein by reference. That control system already receives inputs relating to the rate of feeding fuel to the burner, the composition of the exhaust gases and the temperature of the exhaust gases. Furthermore it is common for a pressurised steam boiler control system to include sensors for measuring the temperature and pressure of the steam generated by the boiler. Thus it can be seen that all the variables required for the assessment of the mass flow of steam from the boiler may already be available without any extra sensors being required. If desired, however, one or more extra sensors may be provided. For example, a sensor for measuring the temperature of the water being fed into the boiler may be provided.

The assessment of the mass flow of steam from the boiler may be used only as a measure of the flow at a moment in time, or it may also or alternatively be used to provide an assessment of the aggregate amount of steam generated over a certain extended period of time. In the latter case, it may be necessary to allow for other losses within the system, when making the assessment, for example it may be appropriate to assume that a certain percentage of heat is lost during blow down of a boiler. For example an overall loss of 6 percent might be allowed for.

The present invention further provides a method of monitoring the level of water in a pressurised steam boiler, the method including the steps of providing a pair of capacitance probe assemblies mounted in the boiler with each of the probes extending through a range of water levels, the probes being arranged such that the capacitance of each probe varies according to the level of the water, and of measuring the capacitance of each probe, comparing the capacitances to one another to check that they match and using the measurement of the capacitance as an indication of the water level.

The present invention yet further provides a method of assessing in a control unit the mass flow of steam from a pressurised steam boiler by processing input signals including ones enabling assessments to be made of:

a) the heat generated by combustion in the burner b) the temperature and pressure of the steam generated by the boiler c) the heat dissipated other than in the steam.

Although the invention has been defined above with reference to a method, it will be understood that it may also be embodied in an apparatus comprising a pressurised steam boiler. Thus the present invention still further provides a pressurised steam boiler including a boiler housing for containing water in the boiler, a burner for heating water in the boiler and converting the water into steam, a water level detector for monitoring the level of water in the boiler, a pressure detector for detecting the pressure of steam in the boiler, a firing rate detector for detecting the firing rate of the burner, and a control unit which receives input signals from the water level detector, the pressure detector and the firing rate detector and is operative to control the flow rate of water into the boiler in dependence upon said input signals.

The present invention still further provides a pressurised steam boiler including:

a boiler housing for containing water in the boiler, and a water level detector for monitoring the level of water in the boiler, the water level detector comprising a pair of capacitance probe assemblies mounted in the boiler housing with each of the probes extending through a range of water levels, the probes being arranged such that the capacitance of each probe varies according to the level of water, and a control and processing system for measuring the capacitance of each probe, comparing the capacitances and providing an output signal indicative of water level based on the capacitance measurements.

The present invention still further provides a pressurised steam boiler including:

a boiler housing for containing water in the boiler, a burner for heating water in the boiler and converting the water into steam, a pressure detector for detecting the pressure of steam in the boiler, a temperature detector for detecting the temperature of steam in the boiler, a fuel flow detector for measuring the flow rate of fuel into the burner, a further temperature detector for detecting the temperature of the exhaust gases, a control unit for receiving and processing input signals from all of said detectors and for assessing indirectly the mass flow of steam from the boiler.

DESCRIPTION OF THE DRAWINGS

By way of example, an embodiment of the invention will now be described with reference to the accompanying drawings, of which.

DETAILED DESCRIPTION

Figure 1:
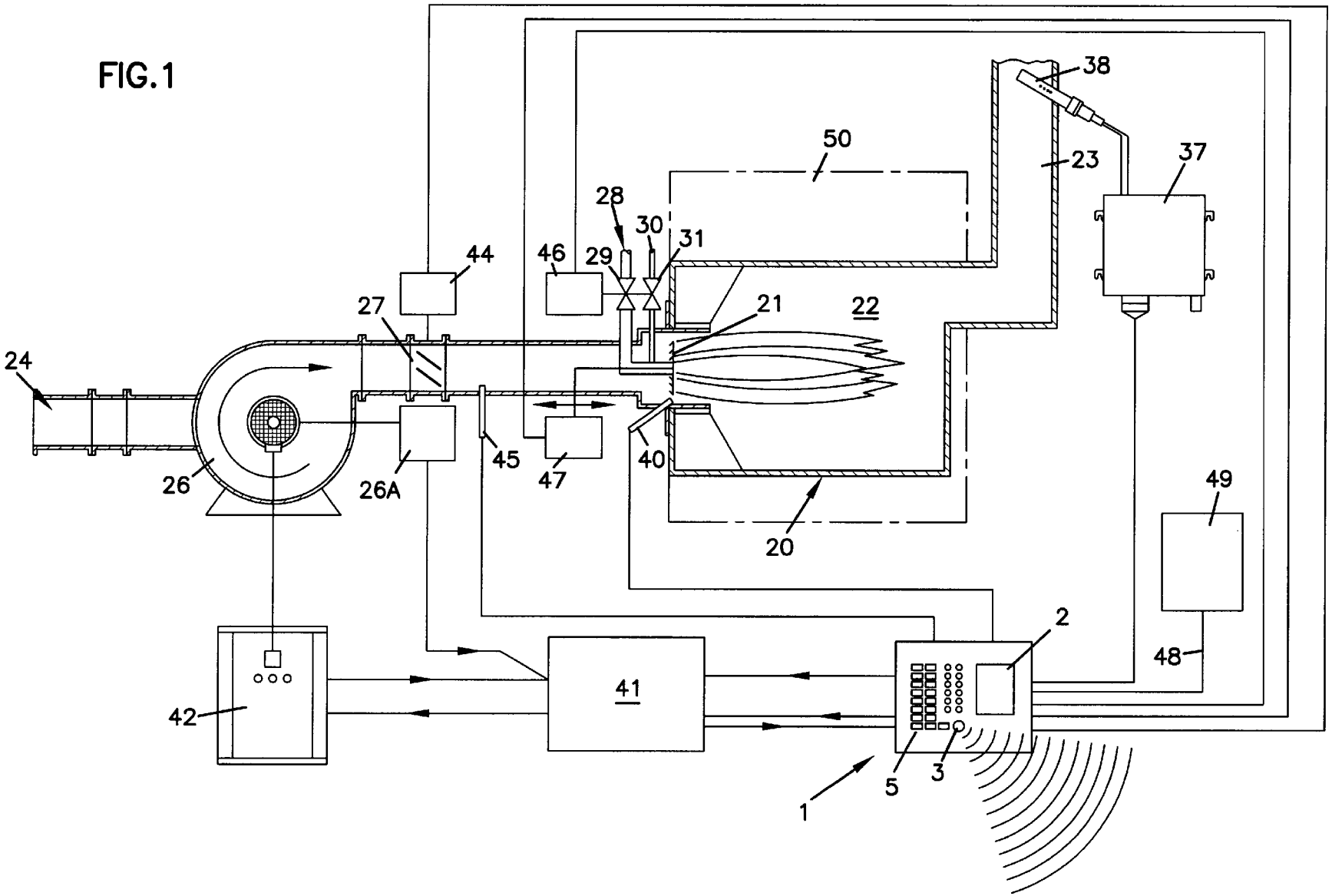
FIG. 1 is a schematic drawing of a burner and a pressurised steam boiler and of a control unit for controlling the burner and steam boiler.

Referring first to FIG. 1, there is shown a burner 20 having a burner head 21, a combustion chamber 22 and a duct 23 for combustion products which comprise exhaust gases. As will be described below the duct 23 passes through a pressurized steam boiler; thereafter the exhaust gases are vented through a flue.

Air is fed to the burner head 21 from an air inlet 24, through a centrifugal fan 26 and then through an outlet damper 27. The burner head 21 is able to operate with either gas or oil as the fuel; gas is fed to the burner head from an inlet 28 via a valve 29 whilst oil is fed to the burner head from an inlet 30 via a valve 31.

A control unit 1 is provided for controlling the operation of the burner and boiler. The control unit 1 is provided for controlling the operation of the burner and boiler. The control unit 1 has a display 2, a proximity sensor 3 for detecting that a person is nearby, a set of keys 5 enabling an operator to enter instructions to the control unit. The purpose of the proximity sensor is not relevant to the present invention and will not be described further herein; its purpose is described in GB2335736A, the description of which is incorporated herein by reference.

The control unit 1 is connected to various sensing devices and drive devices, as shown in the drawing. More particularly the unit is connected via an exhaust gas analyser 37 to an exhaust gas analysis probe 38 (which includes a temperature sensor), and to a flame detection unit 40 at the burner head. The control unit 1 is also connected via an inverter interface unit 41 and an inverter 42 to the motor of the fan 26 (with interface unit 41 receiving a feed back signal from a tachometer 26A associated with the fan 26), via an air servo motor 44 to the air outlet damper 27, to an air pressure sensing device 45 provided in the air supply duct downstream of the outlet damper 27, via fuel servo motors 46 to the fuel valves 29, 31 and to a further servo motor 47 for adjusting the configuration of the burner head 21.

Figure 2:
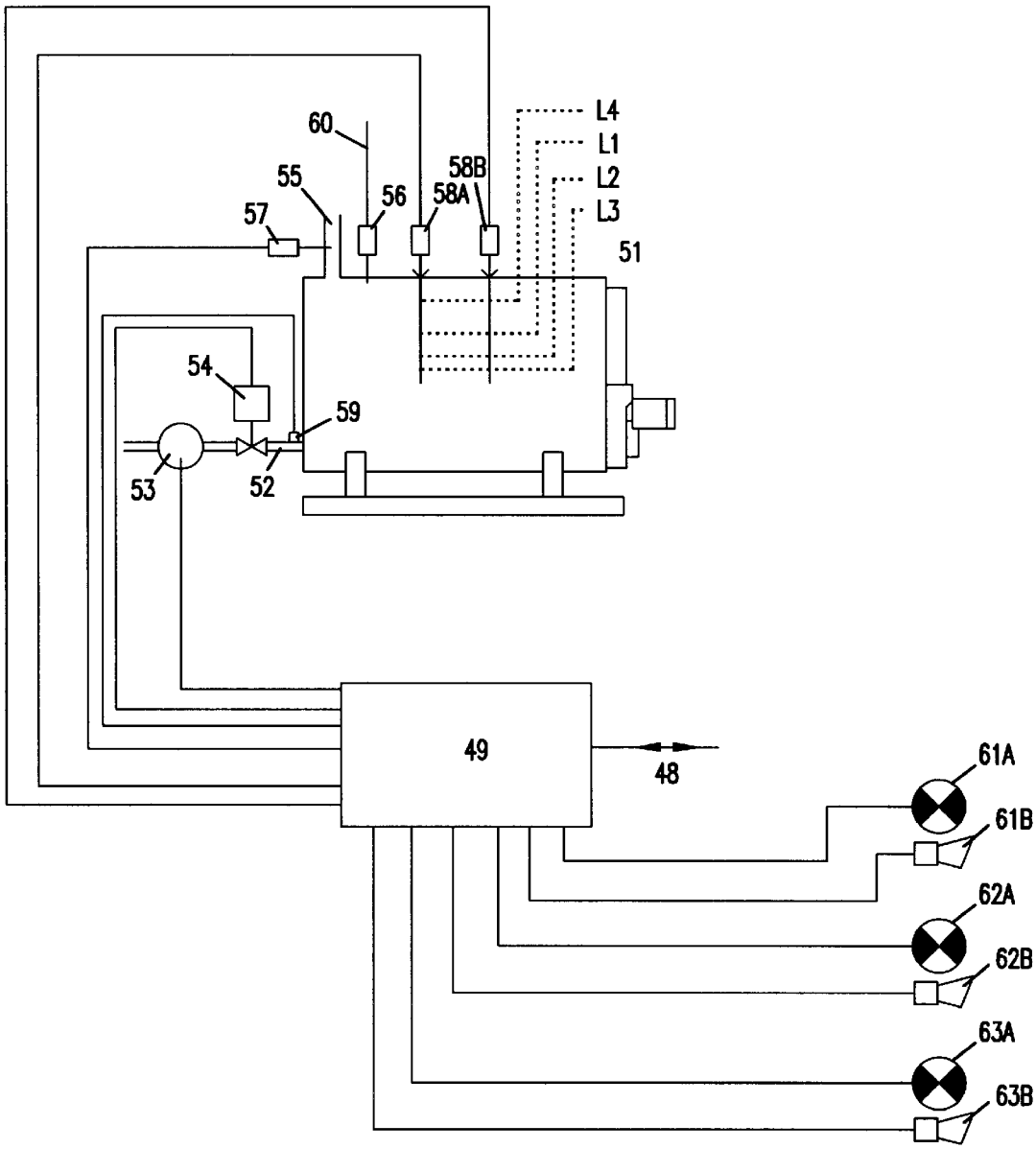
FIG. 2 is a schematic drawing of the pressurised steam boiler of FIG. 1.

The connections described above relate to the control of the burner 20 by the control unit 1. The control unit 1 is, however, also connected, via an RS485 link 48 to a further controller 49, which is shown in FIG. 2 and whose functions are described below.

The combustion chamber 22 of the burner 20 is arranged inside a boiler 50 in a conventional manner. In FIG. 1 the boiler 50 is shown schematically in chain dotted outline. Although FIG. 1 suggests that the combustion chamber leads directly to the exhaust duct 23, it will be understood by those skilled in the art that in practice the gaseous products of combustion follow a serpentine path passing through the boiler 50 a few times before reaching the exhaust duct 23 and being exhausted to atmosphere, FIG. 2 provides a schematic representation of the boiler and shows a boiler housing 51 which in normal use is filled to approximately the height shown by dotted line L1 in FIG. 2. It will be appreciated that the combustion chamber and ducting for the exhaust gases are not shown in FIG. 2.

A water pipe 52 feeds water into the bottom of the boiler at a rate determined by settings of a pump 53 and a motorized control valve 54. A temperature detector 59 senses the temperature of the water as it enters the boiler.

A steam outlet pipe 55 takes steam under pressure from the top of the boiler 51. The pressure of the steam taken from the boiler housing 51 is sensed by a pressure detector 56 while its temperature is sensed by a temperature detector 57. Mounted in the top of the boiler housing 51 are a pair of capacitance probe assemblies 58A and 59B. The capacitance probe assemblies are identical to one another and one is described below with reference to FIGS. 3 and 4.

The further controller 49 receives input signals from the following (excluding the connection via the RS485 link 48 to the control unit 1);

a) each of the capacitance probe assemblies. 58A and 58B;

b) the steam temperature detector 57;

c) the inlet water temperature detector 59;

d) the control valve 54 (a feedback signal indicating the degree of opening of the control valve 54); and e) the pump 53 (a feedback signal indicating the setting of the pump).

In addition a signal from the pressure detector 56 is passed back along a line 60 (not shown in FIG. 1) to the control unit 1 where it provides an input signal representing demand to the control unit.

The further controller 49 provides output signals to the following (excluding the connection via the RS485 link 48 to the control unit 1):

i) the control valve 54 (to adjust the degree of opening of the valve);

ii) the pump 53 (to adjust the setting of the pump);

iii) a warning light and audible alarm 61A, 61B, respectively, which are activated when the water level falls to a first low water level below its normal operating range "first low");

iv) a warning light and audible alarm 62A, 62B, respectively, which are activated when the water level falls to a second low water level below the first water level ("second low"); and v) a warning light and audible alarm 63A, 63B, respectively, which are activated when the water level rises to a high water level above its normal operating range.

In FIG. 2, the dotted line L1 indicates the centre of the normal operating range of water level in the boiler. Also shown is a dotted line L2 marking the "first low", a dotted line L3 marking the "second low" and a dotted line L4 marking the high water level.

Figure 3:
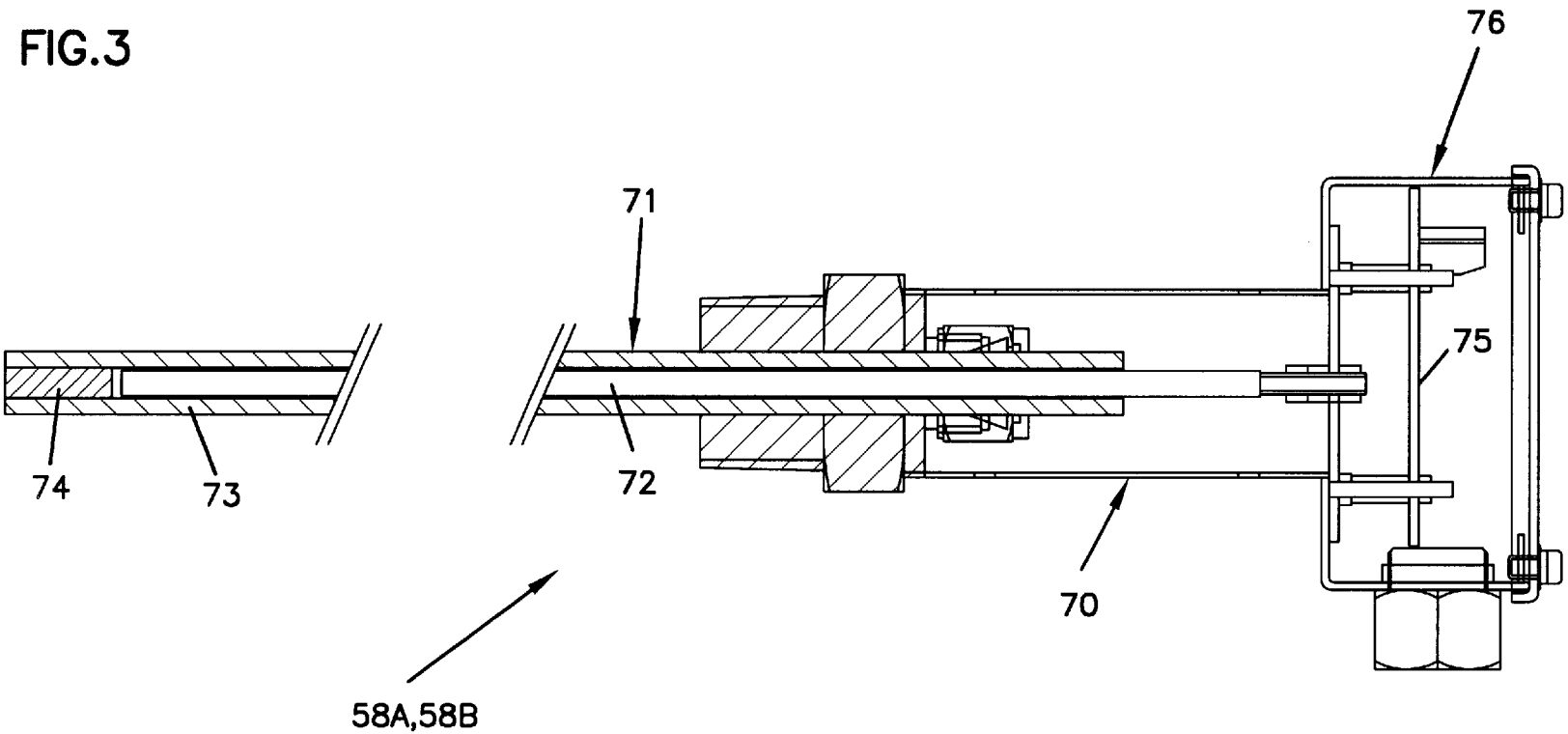
FIG. 3 is a sectional view of one of a pair of capacitance probe assemblies employed in the pressurised steam boiler shown in FIG. 2.

Referring now also to FIG. 3, it can be seen that each capacitance probe assembly 58A, 58B includes a main body 70 and an elongate probe 71 which projects downwardly into the interior of the boiler and extends through the high water level (L4), the normal operating level (L1), the "first low" (L2) and the "second low" (L3). Since boilers vary in size the probes 71 are manufactured in various lengths and an appropriate length of probe is chosen for each boiler. For example, the probes may be available in lengths of about 0.5 m, 1.0 m and 1.5 m.

Each probe 71 is formed from a central steel bar 72 surrounded by a sleeve 73 of dielectric material. Also a plug 74 of dielectric material is provided at the free end of the sleeve 73 to seal that end of the probe. Thus, in a manner that is know per se, the probe 71 forms together with the medium surrounding the sleeve 73 a variable capacitance. Since the capacitance is very dependent on whether the medium is water or steam the value of the capacitance is dependent upon how great a length of the probe is surrounded by water rather than steam. Thus, the capacitance of the probe provides an indication of the level of water in the boiler, for all levels between, and including, L3 and L4.

Figure 4:
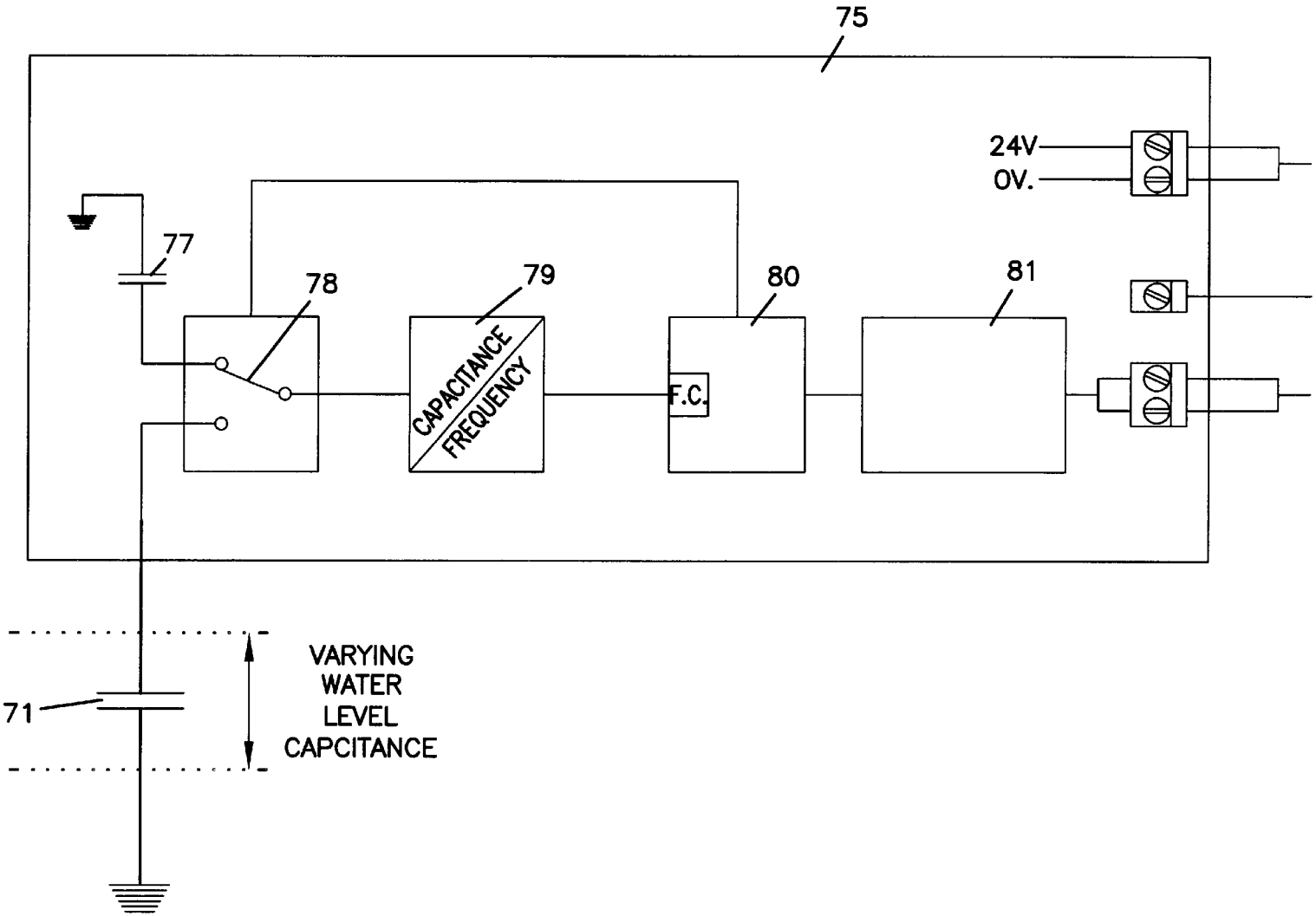
FIG. 4 is a block circuit diagram of the signal control and processing arrangement provided in each capacitance probe assembly.

Within the main body 70 of the capacitance probe assembly, there is a secure physical and electrical connection to the probe and a printed circuit board 75 is mounted in an enlarged rear portion 76 of the main body 70, the board 75 carrying the necessary processing circuitry, which is shown in block diagram form in FIG. 4.

Referring now also to FIG. 4, there is shown the probe 71 marked as a varying capacitance, a reference capacitance 77, a relay 78 for alternately connecting the probe 71 and the reference capacitance in the circuit, an oscillator 79, a processor 80 which both controls the operation of the relay 78 and together with the oscillator 79 is able to provide a measure of the capacitance being sensed by detecting the frequency of a signal in a circuit incorporating the capacitance, and a driver 81 which transmits a signal from the probe assembly to the further controller 49. The connection between each probe assembly 58A, 58B and the further controller 49 is made via RS485 links.

In a particular example of the invention, the probe capacitance varies from 10 pF to 200 pf, the reference capacitance 77 is 50 pF, the oscillator 79 is a 555 Type Oscillator, the processor 80 is an 80188 processor and the sleeve 73 is 12 mm outside diameter, 6 mm inside diameter and is made of PTFE (polytetra-fluoroethylene).

When connected in the control system shown in FIGS. 1 and 2, the capacitance of each probe 71 is measured alternately with the reference capacitance 77 of that probe. Also the controller 49 reads signals from each of the probe assemblies 58A, 58B alternately. Typically in a steam boiler, the water is somewhat turbulent at least near the surface and that gives rise to some inaccuracy in the measurement made. Thus the controller 49 is arranged to allow for some discrepancy in the signals from the probe assemblies 58A, 58B, but apart from that checks both that the signal of the reference capacitance indicates the correct value of capacitance and that each of the probes 71 indicates the same value of capacitance and therefore the same water level.

The use of the two identical probe assemblies 58A, 58B each with its own reference capacitance for checking purposes and with all readings from both probe assemblies being checked against one another, results in an especially safe system.

The normal operation of the burner and boiler will be well understood to those skilled in the art from the description above and will not be described further herein. GB2138610A and GB2169726A both provide further details of the normal operation of the burner. The boiler operates in a conventional manner when the water level is normal and, via the controller 49, feeds back signals, for example indicating a dropping steam temperature, to the control unit 1. In the event that the water level in the boiler drops to below the average normal level, then the controller 49 is programmed to adjust the control valve 54 and/or the pump 53 at the water inlet to allow more water into the boiler; similarly, in the event that the water level in the boiler rises gradually a little above the average normal level, then the controller 49 is programmed to adjust the control valve 54 and/or the pump 53 at the water inlet to allow less water into the boiler. In either case, however, the operation of the burner 20 is not affected because the output signals from the control unit 1 are not altered.

If, however, for example, the water level in the boiler falls to the level L2 shown in FIG. 2, then the controller 49 reacts in various ways: firstly the warning light 61A and audible alarm 61B are actuated; secondly a signal is passed back via the RS485 link 48 to the control unit 1 which then shuts down the burner 20 by turning off the supplies of fuel and air to the burner head 21; thirdly, the inlet flow of water into the boiler 5 is increased by adjustment of the. control valve 54 and/or the pump 53.

Provided that the water level then rises back towards the level L1, the controller 49 can reverse the measures described in the paragraph immediately above. If for some reason, however, the water level continues to fall, for example because the water inlet is blocked, then when it reaches the level L3 in FIG. 2 the warning light 62A and the audible alarm 62B are activated and a further control signal sent from the controller 49 to the control unit 1, preventing the burner from being turned back on without manual intervention by an operator.

Similarly, if the water level in the boiler rises to the level L4 shown in FIG. 2, then the controller 49 reacts in various ways: firstly the warning light 63A and the audible alarm 63B are activated; secondly a signal is passed back via the RS485 link 48 to the control unit 1 which then shuts down the burner 20 by turning off the supplies of fuel and air to the burner head; thirdly, the inlet flow of water into the boiler 5 is stopped by adjustment of the control valve 54 and/or the pump 53.

The linking of the control of the boiler and the control of the burner enables other more sophisticated and advantageous control techniques to be adopted. In particular, whereas a skilled person would expect the system to be programmed simply so that, whenever the water level rose, the inlet flow rate of water was reduced, that need not be the case.

Although a rise in water level in the boiler is usually a result of the amount of steam leaving the boiler per unit time being less at that time than the amount of water coming into the boiler per unit time, it is possible, paradoxically, for the rise in water level to occur even when the rate at which steam is leaving the boiler is greater than the rate at which water is coming into the boiler. As explained above, that can arise when there is a sudden demand for steam leading to a reduction in pressure in the boiler and consequent expansion of the small bubbles within the water in the boiler, causing the water to expand and thus the water level to rise. The embodiment of the invention described herein is able to identify this special circumstance as will now be described.

The reaction to an increasing water level is determined by assessing within the control system also how the steam pressure in the boiler, which is measured by the detector 56, is changing and how the firing rate of the burner 20, which can for example be assessed from the information in the control unit 1 of the amount of fuel being fed to the burner, is changing. The variables of water level, steam pressure and firing rate can each be sensed at one second intervals and their movements over the last twenty seconds used to assess the cause of an increase in water level.

For example, in a case where the water level is increasing at a slow rate, the pressure in the boiler is increasing at a slow rate and the firing rate is reducing, that is a good indication that the increase in water level is simply caused by a reduction in the demand for steam. Thus, in response to the control unit 1 and the controller 49 receiving signals indicative of that situation, the controller 49 acts to reduce at a slow rate the amount of water per unit time entering the boiler through the pipe 52.

On the other hand, in a case where the water level is increasing at a fast rate, the pressure in the boiler is reducing at a fast rate and the firing rate is increasing, that is a good indication that the increase in water level is actually a result of a sudden demand for steam. Thus, in response to the control unit 1 and the controller 49 receiving signals indicative of that situation, the controller 49 acts to maintain, at its current rate the amount of water per unit time entering the boiler through the pipe 52.

It will be appreciated that the precise control criteria that are applied can be varied by the designer of the control system and/or by the commissioning engineer who installs the control system. As well as selecting values for what may be regarded as a "slows or fast" rate of change of a variable, it is also of course possible to introduce values of other variables in the decision-making process for controlling the water level. By combining the control of the burner and the boiler as described above such arrangements become possible.

The control system described above is also able to assess the amount of steam per unit time that is leaving the boiler and, therefore, can dispose with the need for one or more steam flow meters. The assessment is accomplished by assessing all the energy input per unit time into the burner and boiler and the energy output per unit time other than in the steam. The difference between the energy input and the energy output as so assessed is of course a measure of the energy that has been put into the water/steam in the boiler. Provided the approximate temperature of the water passed into the system is known and the temperature and pressure of the steam are also known it becomes possible to calculate the mass flow rate of the steam. The accuracy with which the energy inputs and outputs are assessed is a matter of design choice, but one particular example is given below.

The energy input to the system is regarded as consisting exclusively of the heat generated from combustion of the fuel in the burner 20. The control unit 1 is able to compute the amount of fuel being combusted and, if desired, can also take into account the exhaust gas analysis results from the analyser 37 to arrive at the rate of energy input at any one time. During commissioning of the control unit 1, a calibrated fuel meter may be used in order that the control unit 1 is able to store a value of the fuel flow rate and/or heat energy input corresponding to each of a plurality of settings of the fuel valve. The control unit 1 is then able to arrive at appropriate values for any intermediate settings by interpolation.

The energy outputs from the system, apart from the steam are regarded as comprising the following:

i) the energy in the hot exhaust gases after they have passed through the boiler;

ii) losses from the burner and boiler in heat that is transferred to the surroundings via radiation, conduction and convection.

The control unit 1 is informed of the temperature of the exhaust gases from the exhaust gas analyser 37 and is able to compute the flow rate of exhaust gases from the amounts of fuel and/or air being fed to the burner. For the losses from the burner and boiler, it is assumed that a fixed percentage of the heat input (in a particular example 0.25%) is lost when the burner is running at maximum firing rate and that the amount of heat lost remains the same at lower firing rates so that if the burner is turned down to, for example, one quarter of its maximum firing rate the percentage loss increases fourfold (in the particular example to 1%)

Thus the control unit 1 is able to assess the energy input into the water in the boiler. From the controller 49 the temperature of the water fed into the boiler is known and the temperature and pressure of the steam leaving the boiler are also known. The heat required to heat water (specific heat) to convert water to steam (latent heat) and to bring steam to a certain temperature and pressure is of course all well established and therefore the data available from the controller 49 when taken with that from the control unit 1 enables the new flow rate of the steam to be computed.

Extra work is required during initial commissioning of the system to calibrate the control unit 1 and the controller 49 so that they provide a good indication of the steam flow rate, but once the commissioning process has been completed and appropriate values stored in look-up tables, the computation of the steam flow rate is automatic.

Thus it can be seen that by linking together the control of the burner and boiler an especially advantageous control system can be provided.

Whilst one particular example of a system has been described, it should be understood that the system may be varied in many respects. For example, in the described embodiment the control unit 1 and the controller 49 are separate physical units; it is, however, possible to locate the controller 49 within the control unit 1 and indeed, if desired, the controller 49 may be integrated wholly into the control unit 1, so that for example they share the same microprocessor.

What is claimed is:

1. A method of controlling the operation of a pressurised steam boiler heated by a burner, the method including the following steps;

a) monitoring the level of water in the boiler, b) monitoring the pressure of steam in the boiler, c) monitoring the firing rate of the burner, and d) controlling the flow rate of water into the boiler having regard to the signals resulting from a) and b) and, at least for some signal conditions, also having regard to signals resulting from c), in which when i) the monitoring of the level of water in the boiler shows a rate of increase above a predetermined level, ii) the monitoring of the pressure of steam in the boiler shows a reduction in pressure at a rate above a predetermined level, and iii) the monitoring of the firing rate of the burner shows that the firing rate is increasing at a rate above a predetermined level, the controlling of the flow rate of water into the boiler is such that it does not necessarily reduce the rate of flow into the boiler.

2. A method according to claim 1, in which said controlling of the flow rate of water into the boiler is such that it does not reduce the rate of flow into the boiler, unless the level of water in the boiler is above an upper normal working limit.

3. A method of controlling the operation of a pressurised steam boiler heated by a burner, the method including the following steps:

a) monitoring the level of water in the boiler, b) monitoring the pressure of steam in the boiler, c) monitoring the firing rate of the burner, and d) controlling the flow rate of water into the boiler having regard to the signals resulting from a) and b) and, at least for some signal conditions, also having regard to signals resulting from c), in which when i) the monitoring of the level of water in the boiler shows an increase in level but at a rate of increase below a predetermined level, ii) the monitoring of the pressure in the boiler shows an increase in pressure but at a rate of increase below a predetermined level, and iii) the monitoring of the firing rate of the burner shows that the firing rate is reducing the controlling of the flow rate of water into the boiler is such that it does reduce the rate of flow into the boiler.

4. A method of controlling the operation of a pressurised steam boiler heated by a burner, the method including the following steps:

a) monitorng the level of water in the boiler, b) monitoring the pressure of steam in the boiler, c) monitoring the firing rate of the burner, and d) controlling the flow rate of water into the boiler having regard to the signals resulting from a) and b) and, at least for some signal conditions, also having regard to signals resulting from c), wherein the step of monitoring the level of water in the boiler includes the steps of providing a pair of capacitance probe assemblies mounted in the boiler with each of the probes extending through a range of water levels, the probes being arranged such that the capacitance of each probe varies according to tile level of the water, and of measuring the capacitance of each probe, comparing the capacitances to one another to check that they match and using the measurement of the capacitance as an indication of the water level.

5. A method according to claim 4, wherein the range of water levels trough which the probes extend includes a first low water level below the normal working range.

6. A method according to claim 5, wherein the range of water levels through which the probes extend includes a second low water level below the first low water level.

7. A method according to claim 5, wherein the range of water levels through which the probes extend includes a high water level above the normal working range.

8. A method according to claim 4, wherein the pair of capacitance probe assemblies are substantially identical.

9. A method according to claim 4, wherein each capacitance probe assembly includes in addition a reference capacitance whose capacitance value is sensed alternately with the probe capacitance value.

10. A method according to claim 4, wherein the measurement of the capacitance of one probe alternates with the measurement of the capacitance of the other probe.

11. A method of controlling the operation of a pressurised steam boiler heated by a burner, the method including the following steps:

a) monitoring the level of water in the boiler, b) monitoring the pressure of steam in the boiler, c) monitoring the firing rate of the burner, d) controlling the flow rate of water into the boiler having regard to the signals resulting from a) and b) and, at least for some signal conditions, also having regard to signals resulting from c), and e) assessing in a control unit the mass flow of steam from the boiler by processing of input signals including ones enabling assessments to be made of:

i) the heat generated by combustion in the burner, ii) the temperature and pressure of the steam generated by the boiler, and iii) the heat dissipated other than in the steam.

12. A method according to claim 11, wherein variables measured to assess the heat generated by combustion in the burner include the rate of feeding of fuel to the burner.

13. A method according to claim 11, wherein variables measured to assess the heat generated by combustion in the burner include the composition of the combustion products.

14. A method according to claim 11, wherein variables measured to assess the heat dissipated other than in the steam include the temperature of the combustion products.

15. A method according to claim 11, wherein variables measured to assess the heat dissipated other than in the steam include the rate of feeding of fuel to the burner.

16. A method according to claim 11, wherein the input signals that are processed to assess the mass flow of steam from the boiler include a signal representing the temperate of the water being fed into the boiler.

17. A method of assessing in a control unit the mass flow of steam from a pressurised steam boiler by processing input signals including ones enabling assessments to be made of:

a) the heat generated by combustion in the burner b) the temperature and pressure of the steam generated by the boiler c) the heat dissipated other than in the steam.

18. A method according to claim 17, wherein variables measured to assess the heat generated by combustion in the burner include the rate of feeding of fuel to the burner.

19. A method according to claim 17, wherein variables measured to assess the heat generated by combustion in the burner include the composition of the combustion products.

20. A method according to claim 17, wherein variables measured to assess the heat dissipated other than in the steam include the temperature of the combustion products.

21. A method according to claim 17, wherein variables measured to assess the heat dissipated other than in the steam include the rate of feeding of fuel to the burner.

22. A method according to claim 17, wherein the input signals that are processed to assess the mass flow of steam from the boiler include a signal representing the temperature of the water being fed into the boiler.

23. A pressurised steam boiler including:

a boiler housing for containing water in the boiler, a burner for heating water in the boiler and converting the water into steam, a pressure detector for detecting the pressure of steam in the boiler, a temperature detector for detecting the temperature of steam in the boiler, a fuel flow detector for measuring the flow ate of fuel into the burner, a further temperature detector for detecting the temperature of the exhaust gases, and a control unit for receiving and processing input signals from all of said detectors and for assessing indirectly the mass flow of steam from the boiler and an exhaust gas detector for analysing the composition of the combustion products, the control unit being arranged to receive and process also an input signal from the exhaust gas detector for assessing indirectly the mass flow of steam from the boiler.

24. A pressurised steam boiler including:

a boiler housing for containing water in the boiler, a burner for heating water in the boiler and converting the water into steam, a pressure detector for detecting the pressure of steam in the boiler, a temperature detector for detecting the temperature of steam in the boiler, a fuel flow detector for measuring the flow rate of fuel into the burner, a further temperature detector for detecting the temperature of the exhaust gases, and a control unit for receiving and processing input signals from all of said detectors and for assessing indirectly the mass flow of steam from the boiler, and a still further temperature detector for detecting the temperature of water at an inlet to the boiler, the control unit being arranged to receive and process also an input signal from the still further temperature detector for assessing indirectly the mass flow of steam from the boiler.

* * * * *